US009116459B2

(12) United States Patent
Yamamoto et al.

(10) Patent No.: US 9,116,459 B2
(45) Date of Patent: Aug. 25, 2015

(54) ELECTROPHOTOGRAPHIC IMAGE FORMING APPARATUS

(71) Applicant: CANON KABUSHIKI KAISHA, Tokyo (JP)

(72) Inventors: Shinya Yamamoto, Numazu (JP); Kodai Hayashi, Suntou-gun (JP); Hisashi Taniguchi, Suntou-gun (JP); Yuichiro Hirata, Boise, ID (US)

(73) Assignee: CANON KABUSHIKI KAISHA, Tokyo (JP)

( * ) Notice: Subject to any disclaimer, the term of this patent is extended or adjusted under 35 U.S.C. 154(b) by 54 days.

(21) Appl. No.: 13/863,546

(22) Filed: Apr. 16, 2013

(65) Prior Publication Data

US 2013/0287435 A1 Oct. 31, 2013

(30) Foreign Application Priority Data

Apr. 26, 2012 (JP) ..... 2012-101861

(51) Int. Cl.
*G03G 21/18* (2006.01)
*G03G 15/08* (2006.01)
*G03G 15/00* (2006.01)

(52) U.S. Cl.
CPC ..... *G03G 15/0806* (2013.01); *G03G 15/0808* (2013.01); *G03G 15/5008* (2013.01)

(58) Field of Classification Search
CPC ..... G03G 15/5008; G03G 15/08; G03G 15/0808; G03G 21/1821; G03G 21/18536
USPC ..... 399/111, 113, 279, 281
See application file for complete search history.

(56) References Cited

U.S. PATENT DOCUMENTS 6,954,595 B2 10/2005 Tsukida et al.
6,980,759 B2 * 12/2005 Kanno et al. ..... 399/111

(Continued)

FOREIGN PATENT DOCUMENTS

JP H08-185049 A 7/1996
JP 2004-110011 A 4/2004

(Continued)

OTHER PUBLICATIONS

Yoshihiro Mitsui et al, U.S. Appl. No. 13/862,761, filed Apr. 15, 2013.

(Continued)

*Primary Examiner* — Hoang Ngo
(74) *Attorney, Agent, or Firm* — Fitzpatrick, Cella, Harper & Scinto

(57) ABSTRACT

An electrophotographic image forming apparatus includes an electrophotographic photosensitive member configured to bear an electrostatic latent image, and a developer carrying member configured to develop the electrostatic latent image. The electrophotographic photosensitive member and the developer carrying member are separated from each other during non-image formation and brought into contact with each other after the electrophotographic photosensitive member and the developer carrying member start to be rotated. During a time period between a time when the electrophotographic photosensitive member and the developer carrying member start to be rotated and a time when the electrophotographic photosensitive member and the developer carrying member are brought into contact with each other, a number of revolutions of the developer feed member is larger than a number of revolutions of the developer carrying member.

15 Claims, 7 Drawing Sheets

(56) References Cited

U.S. PATENT DOCUMENTS

| | | | |
|---|---|---|---|
| 7,068,956 | B2 | 6/2006 | Tsukida et al. |
| 7,962,057 | B2 | 6/2011 | Yamamoto et al. |
| 8,064,810 | B2 | 11/2011 | Okumura et al. |
| 8,160,464 | B2 | 4/2012 | Yamamoto et al. |
| 8,175,476 | B2 | 5/2012 | Yamamoto et al. |
| 8,285,166 | B2 | 10/2012 | Yamamoto et al. |
| 8,401,420 | B2 | 3/2013 | Nagae et al. |
| 8,463,148 | B2 | 6/2013 | Yamamoto et al. |
| 8,594,527 | B2 | 11/2013 | Nagae et al. |
| 2004/0101322 | A1 | 5/2004 | Tsukida et al. |
| 2005/0201766 | A1 | 9/2005 | Tsukida et al. |

FOREIGN PATENT DOCUMENTS

| | | | |
|---|---|---|---|
| JP | 2005-70653 | A | 3/2005 |
| JP | 2006-091526 | A | 4/2006 |
| JP | 2006-126555 | A | 5/2006 |
| JP | 2006-292868 | A | 10/2006 |
| JP | 2010-008993 | A | 1/2010 |
| JP | 2011-215434 | A | 10/2011 |

OTHER PUBLICATIONS

Japanese Office Action dated Jun. 16, 2015, in related Japanese Patent Application No. 2014-059556.

* cited by examiner

ELECTROPHOTOGRAPHIC IMAGE FORMING APPARATUS

BACKGROUND OF THE INVENTION

1. Field of the Invention

The present invention relates to an electrophotographic image forming apparatus in which an electrostatic latent image, which is formed on an electrophotographic photosensitive member by bringing a developer carrying member into contact with the electrophotographic photosensitive member, is developed with developer.

The electrophotographic image forming apparatus is herein configured to form an image onto a recording medium (such as recording sheet, OHP sheet, and cloth) with an electrophotographic image forming process. Examples of the electrophotographic image forming apparatus include an electrophotographic copying machine, an electrophotographic printer (such as laser beam printer and LED printer), a facsimile machine, and a multifunction peripheral (multifunction printer) having functions of those apparatus.

2. Description of the Related Art

In recent years, a color image forming apparatus for forming a color image with developers of a plurality of colors has become widely spread. As the color image forming apparatus, there has been known what is called an in-line type image forming apparatus including photosensitive drums which correspond respectively to image forming operations respectively using the developers of a plurality of colors and are disposed in line along a moving direction of a surface of a transfer-object member, onto which toner images are to be transferred. The in-line type image formation is preferred in ease of meeting demands for an increase in speed of image formation, extensive application to the multifunction printer.

In some of the in-line type image forming apparatus, the plurality of photosensitive members are disposed below an intermediate transfer member as a member on which an image is to be transferred or a recording material carrying member for conveying a recording material as a member on which an image is to be transferred. When the plurality of photosensitive members are disposed below the intermediate transfer member or the recording material carrying member, for example, a fixing device and a developing device (or exposure device) can be disposed at positions separate from each other while interposing the intermediate transfer member or the recording material carrying member therebetween in a main body of the image forming apparatus. Thus, the developing device (or exposure device) is hard to be influenced by heat of the fixing device, which is an advantage of the in-line type image forming apparatus.

In many of the color image forming apparatus, a contact developing process is widely employed in terms of advantages of high reproducibility of a halftone image and marked suppression of an excessive edge effect of an image. The contact developing process refers to a process in which the developer carrying member of a developing unit is brought into contact with the electrophotographic photosensitive member and a latent image formed on the electrophotographic photosensitive member is developed with developer (toner).

In a general configuration for the contact developing process, one of the electrophotographic photosensitive member and the developer carrying member is formed of an elastic member (including sheet backed up by the elastic member) and another of the electrophotographic photosensitive member and the developer carrying member is formed of a rigid member. With this, the electrophotographic photosensitive member and the developer carrying member are firmly fitted to each other uniformly in directions of rotation axes of the electrophotographic photosensitive member and the developer carrying member. In the simplest configuration, a photosensitive drum obtained by coating an outer peripheral surface of an aluminum cylinder with a photosensitive layer is used as the electrophotographic photosensitive member, and a developing roller formed of a rubber elastic member is used as the developer carrying member. In particular, when a process cartridge removably mounted to the main body of the image forming apparatus includes the electrophotographic photosensitive member and the developer carrying member, in many cases, the electrophotographic photosensitive member and the developer carrying member are used in the above-mentioned combination.

Further, the developing roller is brought into contact with a toner feed roller (elastic roller) as a developer feed member configured to feed the developer (toner). With this, toner is fed to the developing roller, and non-developed residual toner is scraped off.

When development is performed by using the contact developing process, the photosensitive drum and the developing roller are driven and rotated while being in contact with each other. Thus, when the contact state is continued unnecessarily long, both the photosensitive drum and the developing roller are abraded against each other due to friction. As a result, the photosensitive drum and the developing roller earlier reach their end of life.

As a countermeasure, as disclosed in Japanese Patent Application Laid-Open No. 2006-292868, there has been proposed a configuration in which the photosensitive drum and the developing roller are allowed to be brought into contact with and separated from each other so that the developing roller is separated from the photosensitive drum during non-development.

However, there may occur a phenomenon called fog, in which toner is transferred from the developing roller onto a non-image portion on the photosensitive drum when the developing roller and the photosensitive drum separated from each other are brought into contact with each other. The fog is caused by insufficient triboelectrification of the toner.

Meanwhile, through repetitive revolutions of the developing roller, the toner carried by the developing roller becomes charged triboelectrically. Thus, an electric charge amount of the toner increases to an appropriate value, with the result that the fog phenomenon described above is suppressed. However, in this case, the developing roller is rotated over a longer period of time, and hence the problem that the developing roller earlier reaches its end of life occurs as described above.

In particular, as for a counter rotation configuration in which the developing roller and the toner feed roller are rotated in directions reverse to each other at a contact portion therebetween, the toner feed roller is rotated slower than the developing roller. Thus, in order to refresh toner captured in the toner feed roller by causing the toner feed roller to rotate one revolution, the developing roller needs to rotate one or more revolutions. As a result, the number of revolutions of the developing roller increases, which causes a problem that the developing roller much earlier reaches its end of life.

SUMMARY OF THE INVENTION

The present invention provides an electrophotographic image forming apparatus which suppresses a fog phenomenon which may occur immediately after contact of a photosensitive drum and a developing roller, and also suppresses shortening of the life of the developing roller due to its revolutions for triboelectrification of toner.

According to an embodiment of the present invention, there is provided an electrophotographic image forming apparatus, including: an electrophotographic photosensitive member configured to bear an electrostatic latent image; a developer carrying member configured to carry developer and develop the electrostatic latent image in a state in which the developer carrying member is in contact with the electrophotographic photosensitive member; and a developer feed member configured to feed the developer to the developer carrying member in a state in which the developer feed member is in contact with the developer carrying member, wherein the electrophotographic photosensitive member and the developer carrying member are separated from each other during non-image formation and brought into contact with each other after the electrophotographic photosensitive member and the developer carrying member start to be rotated, and wherein, during a time period between a time when the electrophotographic photosensitive member and the developer carrying member start to be rotated and a time when the electrophotographic photosensitive member and the developer carrying member are brought into contact with each other, a number of revolutions of the developer feed member is larger than a number of revolutions of the developer carrying member.

Further features of the present invention will become apparent from the following description of exemplary embodiments with reference to the attached drawings.

DESCRIPTION OF THE EMBODIMENTS

Exemplary Embodiments

In the following, with reference to the drawings, the embodiments of the present invention will be described in detail. Note that, unless dimensions, materials, shapes, relative arrangements, and the like of components are specifically described in the following embodiments, the scope of the present invention is not limited to those factors.

First Embodiment

A first embodiment of the present invention will be described with reference to FIGS. 1 to 6.

(Image Forming Apparatus)

Figure 1:
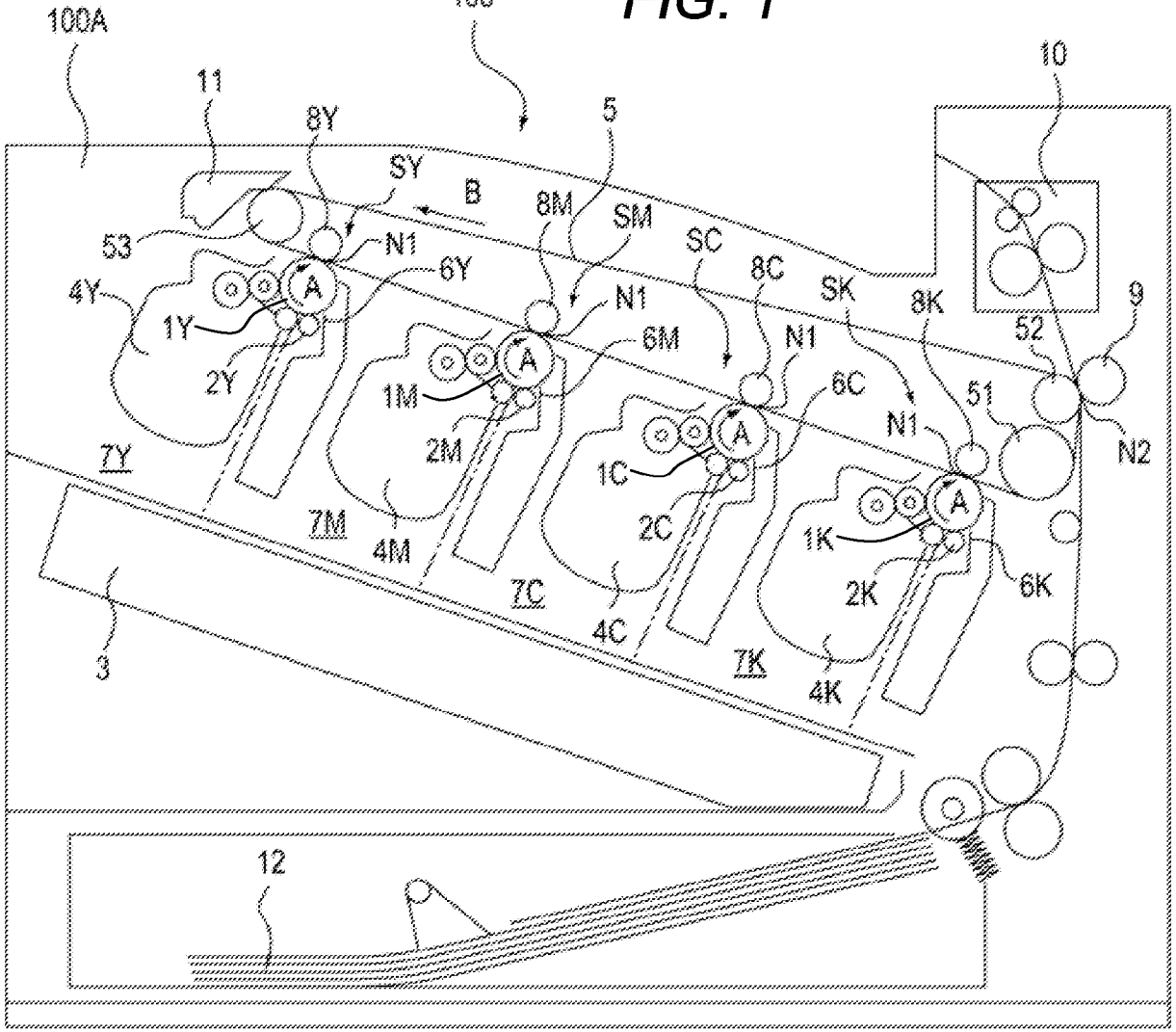
FIG. 1 is a schematic overall structural view of an example of an electrophotographic image forming apparatus according to a first embodiment.

First, with reference to FIG. 1, an overall structure of an electrophotographic image forming apparatus (image forming apparatus) will be described. FIG. 1 is a schematic sectional view of an image forming apparatus 100 according to the embodiment. The image forming apparatus 100 according to the embodiment is a full-color laser printer of an in-line type and an intermediate transfer type.

The image forming apparatus 100 is configured to form a full-color image onto a recording material (such as recording sheet, plastic sheet, and cloth) based on image information. The image information is input to an image forming apparatus main body 100A from an image reading apparatus connected to the image forming apparatus main body 100A or from a host apparatus such as a personal computer communicably connected to the image forming apparatus main body 100A.

The image forming apparatus 100 includes, as a plurality of image forming portions, a first image forming portion SY, a second image forming portion SM, a third image forming portion SC, and a fourth image forming portion SK configured to form yellow (Y), magenta (M), cyan (C), and black (K) images, respectively. In the embodiment, the first image forming portion SY, the second image forming portion SM, the third image forming portion SC, and the fourth image forming portion SK are disposed in line in a direction intersecting with a vertical direction.

Note that, in the embodiment, the first image forming portion SY, the second image forming portion SM, the third image forming portion SC, and the fourth image forming portion SK each have substantially the same structure and perform substantially the same operations except that their colors of an image to be formed are different. Thus, in the following, unless it is necessary to make specific distinctions, the suffixes Y, M, C, and K each added to reference symbols designating the components so as to express corresponding colors are omitted so that the components are collectively described.

In the embodiment, the image forming apparatus 100 includes, as a plurality of image bearing members, four drum-shaped electrophotographic photosensitive members, that is, photosensitive drums 1 disposed in the direction intersecting with the vertical direction. Around each of the photosensitive drums 1, there are disposed a charging roller 2 as a charging unit configured to uniformly charge a surface of the photosensitive drum 1, and a scanner unit (exposure device) 3 as an exposure unit configured to emit a laser beam according to the image information so that an electrostatic image (electrostatic latent image) is formed on the photosensitive drum 1. Further, there are disposed a developing unit (developing device) 4 configured to develop the electrostatic image into a toner image, and a cleaning member 6 as a cleaning unit configured to remove toner (untransferred residual toner) remaining on the surface of the photosensitive drum 1 after transfer of the toner image. An intermediate transfer belt 5 as an intermediate transfer member configured to transfer the toner image on each of the photosensitive drums 1 onto a recording material 12 is disposed opposite to the four photosensitive drums 1.

Note that, in the embodiment, the developing unit 4 uses, as developer, a non-magnetic one-component toner. Further, in the embodiment, the developing unit 4 is configured to perform reversal development by bringing a developing roller 17 (described below) as a developer carrying member into contact with the photosensitive drum 1. Specifically, in the embodiment, the developing unit 4 develops an electrostatic image by causing toner, which is charged with the same polarity as a charging polarity of the photosensitive drum 1 (negative polarity, in this case), to adhere to a part at which electric charge is reduced by exposure on the photosensitive drum 1 (image portion, or exposure portion).

In the embodiment, the photosensitive drum 1 and the charging roller 2, the developing unit 4, and the cleaning member 6 as processing units acting on the photosensitive drum 1 are integrated into a cartridge to form a process cartridge 7. The process cartridge 7 is removably mounted to the image forming apparatus 100 through a mounting unit such as a mounting guide and a positioning member provided in the image forming apparatus main body 100A. In the embodiment, the process cartridges 7 for the above-mentioned colors each have the same shape, and respectively contain yellow (Y), magenta (M), cyan (C), and black (K) toners.

The intermediate transfer belt 5, which is formed of an endless belt and serves as an intermediate transfer member, is in contact with all the photosensitive drums 1, and moved in circulation (rotated) in a direction indicated by an arrow B in FIG. 1 (counterclockwise direction). The intermediate transfer belt 5 is passed over a driving roller 51, a secondary transfer opposing roller 52, and a driven roller 53 as a plurality of support members.

On the side of an inner peripheral surface of the intermediate transfer belt 5, four primary transfer rollers 8 as primary transfer units are disposed opposite to the photosensitive drums 1, respectively. The primary transfer rollers 8 press the intermediate transfer belt 5 against the photosensitive drums 1. In this way, primary transfer portions N1, in which the intermediate transfer belt 5 and the photosensitive drums 1 are in contact with each other, are formed. A bias having a reverse polarity with respect to a normal charging polarity of the toner is applied to each of the primary transfer rollers 8 from a primary transfer bias power source (high voltage power source) as a primary transfer bias application unit (not shown). In this way, the toner images on the photosensitive drums 1 are transferred (primarily transferred) onto the intermediate transfer belt 5.

Further, on the side of an outer peripheral surface of the intermediate transfer belt 5, a secondary transfer roller 9 as a secondary transfer unit is disposed in a position opposite to the secondary transfer opposing roller 52. The secondary transfer roller 9 is in pressure contact with the secondary transfer opposing roller 52 through the intermediate transfer belt 5. In this way, a secondary transfer portion N2 in which the intermediate transfer belt 5 and the secondary transfer roller 9 are in contact with each other is formed. A bias having a reverse polarity with respect to a normal charging polarity of the toner is applied to the secondary transfer roller 9 from a secondary transfer bias power source (high voltage power source) as a secondary transfer bias application unit (not shown). In this way, the toner images on the intermediate transfer belt 5 are transferred (secondarily transferred) onto the recording material 12.

In further detail, at the time of image formation, first, the surface of the photosensitive drum 1 is uniformly charged by the charging roller 2. Then, the surface of the photosensitive drum 1 thus charged is subjected to scanning exposure with the laser beam emitted according to the image information issued from the scanner unit 3 so as to form an electrostatic image according to the image information on the photosensitive drum 1. Next, the electrostatic image formed on the photosensitive drum 1 is developed into a toner image by the developing unit 4. The toner image formed on the photosensitive drum 1 is transferred (primarily transferred) onto the intermediate transfer belt 5 by the action of the primary transfer roller 8.

For example, at the time of formation of a full-color image, the process described above is sequentially performed in each of the first image forming portion SY, the second image forming portion SM, the third image forming portion SC, and the fourth image forming portion SK. In this way, toner images of the four colors are primarily transferred sequentially in a superimposed manner onto the intermediate transfer belt 5.

After that, in synchronism with movement of the intermediate transfer belt 5, the recording material 12 is conveyed to the secondary transfer portion N2. The toner images of the four colors on the intermediate transfer belt 5 are secondarily transferred in a collective manner onto the recording material 12 by the action of the secondary transfer roller 9 in contact with the intermediate transfer belt 5 through the recording material 12.

The recording material 12 on which the toner images are transferred is conveyed to a fixing device 10 as a fixing unit. The fixing device 10 applies heat and pressure to the recording material 12 so as to fix the toner images to the recording material 12.

The cleaning member 6 removes and collects untransferred residual toner remaining on the photosensitive drum 1 after the primary transfer step. An intermediate transfer belt cleaning device 11 cleans untransferred residual toner remaining on the intermediate transfer belt 5 after the secondary transfer step.

Note that, the image forming apparatus 100 is configured to form a monochromatic image by using only desired one of the image forming portions and a multi-color image by using some (but not all) image forming portions.

(Process Cartridge)

Figure 2:
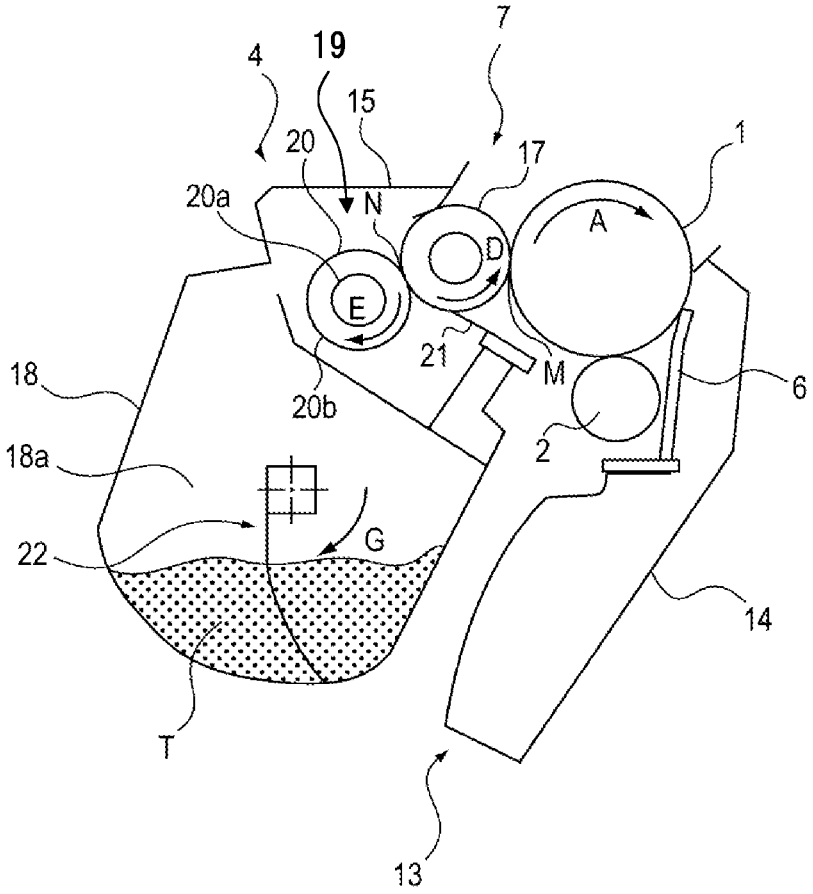
FIG. 2 is a schematic structural view of an example of a process cartridge according to the first embodiment.

Next, with reference to FIG. 2, the process cartridges 7 mounted to the image forming apparatus 100 according to the embodiment will be described. FIG. 2 is a schematic sectional view (main sectional view) of the process cartridge 7 according to the embodiment. Note that, in the embodiment, the process cartridges 7 for the above-mentioned colors each have substantially the same structure and perform substantially the same operations except types (colors) of developers respectively contained therein.

The process cartridge 7 is formed by integrating a photosensitive unit (first unit) 13 including the photosensitive drum 1, and a developing unit (second unit) 4 including the developing roller 17 with each other.

First, the photosensitive unit 13 will be described. The photosensitive unit 13 includes a cleaning frame 14 as a frame configured to support various components in the photosensitive unit 13. The photosensitive drum 1 is rotatably mounted to the cleaning frame 14 through a bearing (not shown).

The photosensitive drum 1 has a diameter of 30 mm. The photosensitive drum 1 is driven and rotated in a direction indicated by an arrow A in FIG. 2 (clockwise direction) along with an image forming operation by a driving force transmitted from a drive motor 34 (FIG. 4) as a driving unit (drive source) to the photosensitive unit 13. In the embodiment, the photosensitive drum 1 as a main component for an image forming process uses an organic photoconductive layer obtained by coating an outer peripheral surface of an aluminum cylinder sequentially with the following functional films: an undercoat layer; a carrier generation layer; and a carrier transport layer.

Further, the photosensitive unit 13 includes the cleaning blade 6 as a cleaning member and the charging roller 2 which are disposed in contact with the peripheral surface of the photosensitive drum 1. The cleaning blade 6 is in contact with the photosensitive drum 1 in a counter direction. With this, the untransferred residual toner removed from the surface of the photosensitive drum 1 is scraped off by the cleaning blade 6, and drops and collected into the cleaning frame 14. The cleaning member is not limited to the cleaning blade 6 exemplified in the embodiment, and may include other cleaning members such as a brush.

The charging roller 2 as a charging unit includes a roller portion made of a conductive rubber, which is brought into pressure contact with the photosensitive drum 1 so that the charging roller 2 is driven and rotated. For a charging step, a predetermined direct-current voltage with respect to the photosensitive drum 1 is applied to a core of the charging roller 2. With this, a dark section potential (Vd=−500 V) is uniformly generated on the surface of the photosensitive drum 1.

The photosensitive drum 1 is subjected to exposure corresponding to a spot pattern of the laser beam emitted according to image data from the above-mentioned scanner unit 3. With this, carrier generated by the carrier generation layer eliminates electric charge at the exposed parts on the surface of the photosensitive drum 1, which causes reduction in absolute value of the electric potential. As a result, an electrostatic latent image including the exposed parts having a predetermined bright section potential (V1=−100 V) and unexposed parts having a predetermined dark section potential (Vd=−500 V) is formed on the photosensitive drum 1.

In order to develop the electrostatic latent image formed on the photosensitive drum 1 into a visible image with toner, a developing bias Vdc of −300 V is applied to the developing roller 17 which is rotated in contact with the photosensitive drum 1.

Next, the developing unit 4 will be described. The developing unit 4 is disposed on a lower side in a gravity direction with respect to a toner feed roller 20 as a developer feed member, and includes a developer containing chamber configured to contain toner T, that is, a toner containing chamber 18.

The toner containing chamber 18 includes an agitating/conveying member 22 provided therein. The agitating/conveying member 22 is configured to agitate the toner T contained in the toner containing chamber 18 and convey the toner T in a direction indicated by an arrow G in FIG. 2 toward an upper portion of the toner feed roller 20. In the embodiment, the agitating/conveying member 22 is driven and rotated at 50 rpm.

The toner T in the embodiment is a negatively chargeable substantially spherical non-magnetic toner as one-component developer. A median particle diameter of the toner particles is set to approximately 7 μm, and hydrophobic silica of 1.5 weight % is externally added as a flow enhancer. By coating surfaces of the toner particles with the extraneous additive, negative chargeability is enhanced. In addition, minute gaps are formed between the toner particles, and hence fluidity is also enhanced.

The developing unit 4 includes a developing frame 15 as a frame configured to support various components in the developing unit 4.

The developing roller 17 is obtained by coating an outer peripheral surface of a core made of stainless steel (SUS) with a conductive elastic member so as to have a diameter of 15 mm. In the embodiment, polyurethane rubber is used as the elastic member. In view of developing performance and image quality, volume resistance of the developing roller 17 at the time of application of a voltage of −50 V is set to range from approximately $10^5\Omega$ to $10^6\Omega$. The developing roller 17 has a hardness of 45° in Asker-C hardness and 25° in JIS-A hardness, and has a surface roughness RzJIS of 7.0 μm.

A developing blade 21 as a developer regulating member is in contact with the developing roller 17 in a counter direction so as to regulate a coating amount of toner fed by the toner feed roller 20 and electrically charge the toner. In the embodiment, the developing blade 21 is formed of a thin plate-like member, specifically, a sheet metal made of stainless steel. The developing blade generates a contact pressure by utilizing spring elasticity of the thin plate-like member. With this, a surface of the developing blade 21 is brought into contact with the toner and the developing roller 17.

The toner as the developer becomes charged triboelectrically by rubbing of the developing blade 21 and the developing roller 17 against each other. At the same time a layer thickness of the toner is regulated. Further, in the embodiment, a predetermined voltage is applied from a blade bias power source (not shown) to the developing blade 21 so as to stabilize the coating amount of the toner. In the embodiment, the developing bias Vdc of −300 V is applied to the developing roller 17 so as to develop the electrostatic latent image formed on the photosensitive drum 1 into a visible image with the toner. Meanwhile, a voltage Vbl of −400 V is applied to the developing blade 21.

The toner feed roller 20 has a diameter of 15 mm. The toner feed roller 20 includes a conductive support member and a foam layer supported by the conductive support layer. Specifically, the toner feed roller 20 includes a core electrode 20*a* as the conductive support member and a urethane foam layer 20*b* as the foam layer provided around the core electrode 20*a*. The urethane foam layer 20*b* is formed of an open cell foam (open cells), that is, continuous cells. The open cell foam of urethane of the surface layer enables inroads of a large number of toner particles into the toner feed roller 20. In the embodiment, the open cells in the surface of the toner feed roller 20 are each formed to have a diameter of from 100 μm to 400 μm, and a hardness of the toner feed roller 20 is set to 60° in Asker-F hardness. Further, in the embodiment, a resistance of the toner feed roller 20 is set to $1\times10^8\Omega$.

Next, how to measure the resistance of the toner feed roller 20 will be described. First, the toner feed roller 20 is brought into contact with an aluminum sleeve having a diameter of 30 mm so that an inroad amount described below is adjusted to 1.0 mm. When the aluminum sleeve is rotated, the toner feed roller 20 is driven and rotated at 30 rpm with respect to the aluminum sleeve. Then, a direct-current voltage of −50 V is applied to the toner feed roller 20. Simultaneously, with a resistor provided on the ground side, which has a resistance of 10 kΩ, a potential difference between both ends of the toner feed roller 20 is measured to calculate a current. In this way, a resistance of the toner feed roller 20 is calculated.

The toner feed roller 20 is disposed to form a predetermined contact portion (nip portion) N on a peripheral surface of the developing roller 17 in an opposing portion with respect to the developing roller 17. In the contact portion N, toner is fed from the toner feed roller 20 to the developing roller 17, and residual toner remaining on the developing roller 17 after development is scraped off.

In the embodiment, the toner feed roller 20 is rotated at 200 rpm in a direction indicated by an arrow E in FIG. 2, and the developing roller 17 is rotated at 100 rpm in a direction indicated by an arrow D in FIG. 2. With this, the toner feed roller 20 and the developing roller 17 are rotated in a manner that the respective surfaces thereof move in the same direction (in the embodiment, direction from above to below) in the contact portion N. In other words, a peripheral speed ratio obtained by dividing a peripheral speed of the toner feed roller 20 by a peripheral speed of the developing roller 17 is 200%. In still other words, within a given time period, the number of revolutions of the toner feed roller 20 is larger than the number of revolutions of the developing roller 17. The inroad amount between the developing roller 17 and the toner feed roller 20 in the contact portion N is 1.0 mm.

The developing roller 17 and the toner feed roller 20 are provided in a developing chamber 19 that is formed through partition on an upper side of the toner containing chamber 18. The agitating/conveying member 22 provided in the toner containing chamber 18 conveys the toner contained in the toner containing chamber 18 toward the upper portion of the toner feed roller 20. In addition, as described above, the developing roller 17 and the toner feed roller 20 are rotated in a manner that the respective surfaces thereof move in the same direction in the contact portion N therebetween. Thus, even in the structure including the developing chamber 19 provided above the toner containing chamber 18, the toner contained in the developing chamber 19 can be used up without provision of a member for agitating and conveying the toner in the developing chamber 19.

(Contact-Separation Mechanism)

Figure 3:
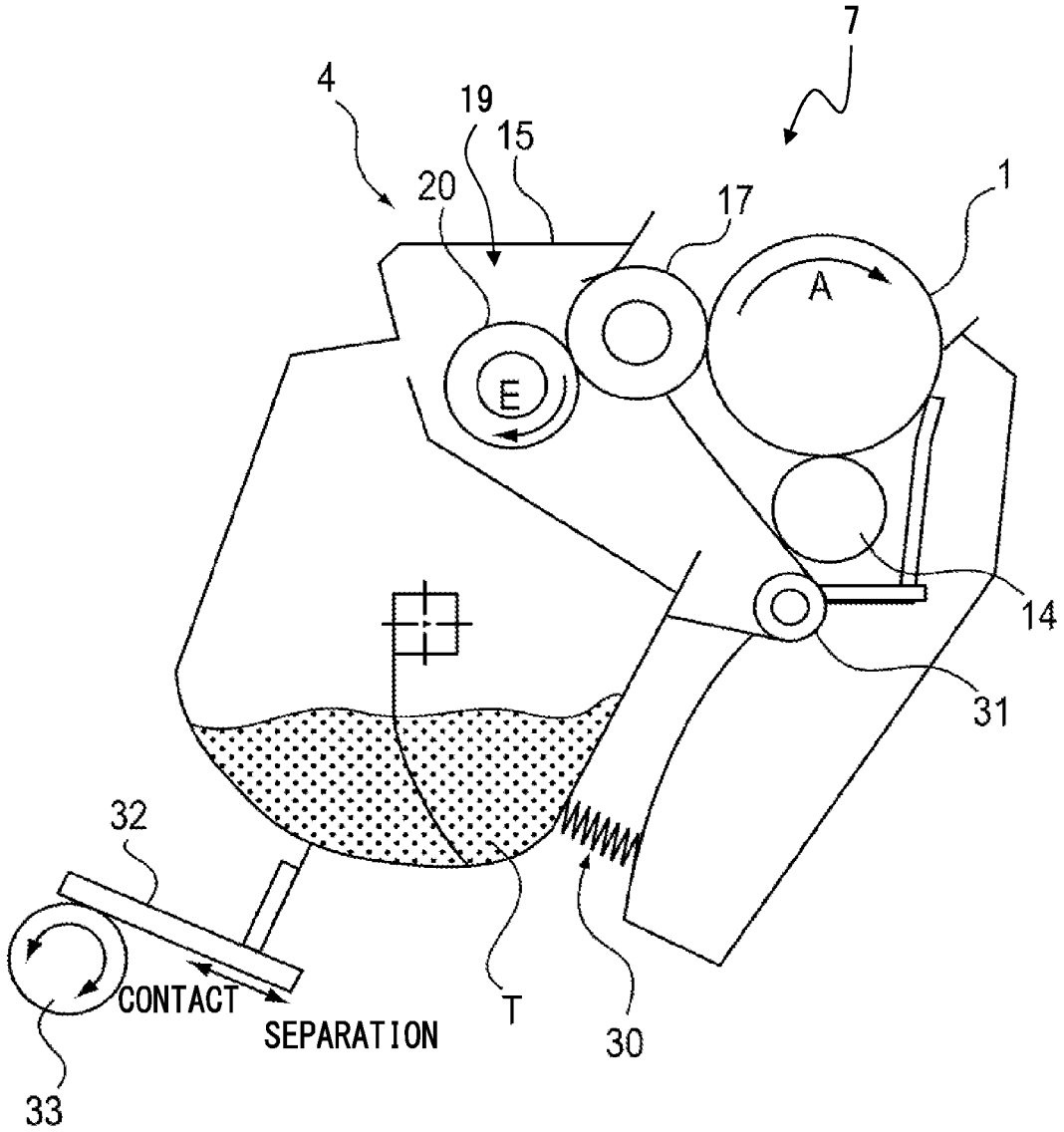
FIG. 3 is a schematic view of a contact-separation mechanism according to the first embodiment.

With reference to FIG. 3, a contact-separation mechanism provided to each of the image forming portions SY, SM, SC, and SK according to an embodiment of the present invention will be described in further detail. Such a contact-separation mechanism in each of the image forming portions SY, SM, SC, and SK has substantially the same structure, and hence will be described by way of an example of only that of the first image forming portion SY.

As illustrated in FIG. 3, the process cartridge 7 is formed by integrating the photosensitive unit 13 including the photosensitive drum 1 with the developing unit 4 including the developing roller 17.

The developing unit 4 is mounted to the photosensitive unit 13 so as to be pivotable about a fulcrum portion 31, and hence can be retreated so that relative positions of the developing roller 17 and the photosensitive drum 1 recede from each other. In the embodiment, the photosensitive drums 1Y to 1K and the developing rollers 17Y to 17K can be brought into contact with each other and separated from each other.

Specifically, in the embodiment, a spring 30 as an urging unit is provided between the photosensitive unit 13 and the developing unit 4. With this, the developing unit 4 pivots about the fulcrum portion 31, and the developing roller 17 is urged in a direction in which the developing roller 17 is brought into contact with the photosensitive drum 1.

Further, as a contact-separation mechanism (contact-separation unit), there are provided a developing device contact-separation lever 32 and a developing device contact-separation motor 33. Along with drive of the developing device contact-separation motor 33, the developing device contact-separation lever 32 moves a lower portion of the developing unit 4 downward. With this, the developing unit 4 is pivoted about the fulcrum portion 31 so that the developing roller 17 is separated from the photosensitive drum 1. Meanwhile, when the developing device contact-separation motor 33 is reversely rotated, the developing device contact-separation lever 32 moves upward. As a result, the developing roller 17 comes closer to the photosensitive drum 1, and in the embodiment, the developing roller 17 comes into contact with the photosensitive drum 1 at the time of use for image formation. In other words, the contact-separation mechanism brings the photosensitive drum 1 and the developing roller 17 into contact with each other during the image formation, and keeps the photosensitive drum 1 and the developing roller 17 to be separated from each other during non-image formation other than the image formation.

(Contact Operation)

Figure 4:
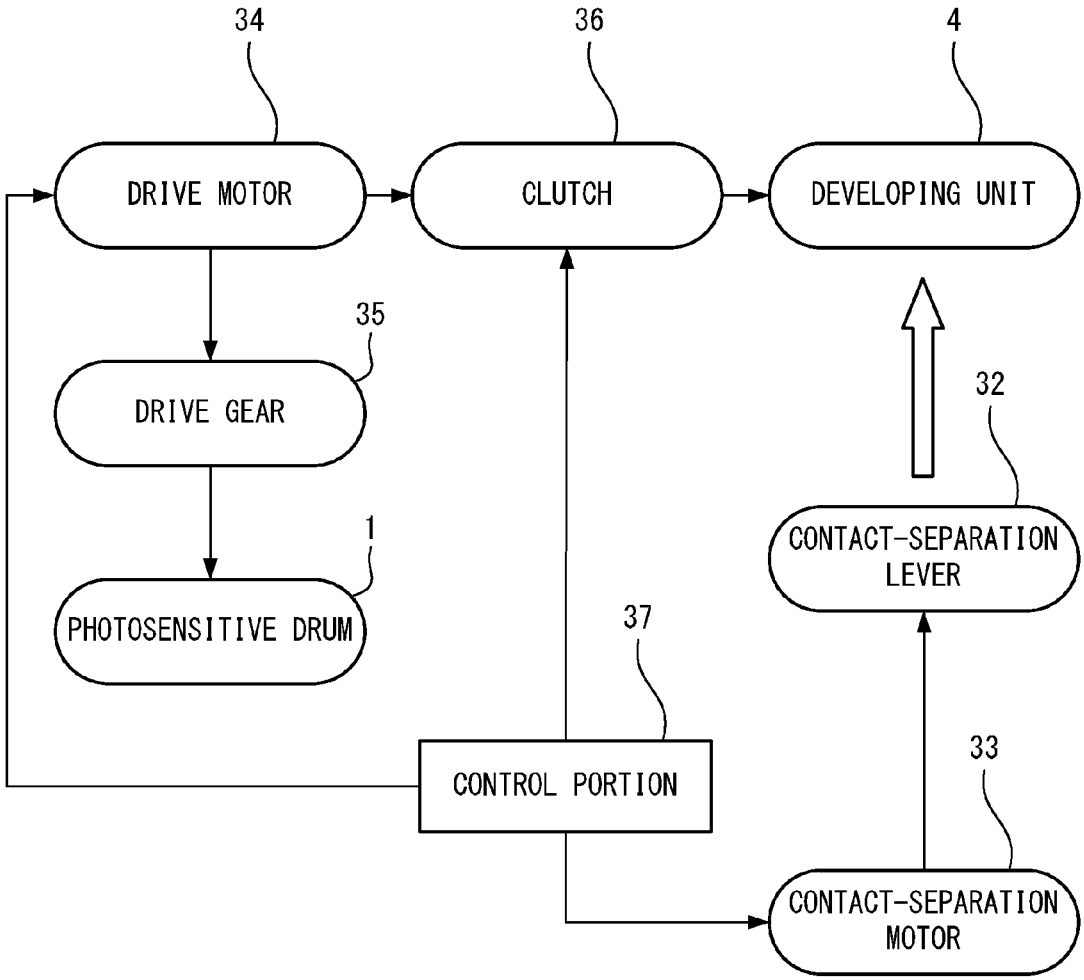
FIG. 4 is a control block diagram according to the first embodiment.

FIG. 4 is a control block diagram according to the embodiment. Such a contact-separation mechanism in each of the image forming portions SY, SM, SC, and SK has substantially the same structure, and hence will be described by way of an example of only that of the first image forming portion SY.

The drive motor 34 as a drive unit (drive device) drives the photosensitive drum 1 and the developing unit 4. Gears (not shown) transmit drive of the drive motor 34 so as to drive and revolve the developing roller 17, the toner feed roller 20, and the agitating/conveying member 22 in the toner containing chamber 18.

The drive motor 34 drives the photosensitive drum 1 and the developing unit 4 respectively through a drive gear 35 and a clutch 36 configured to cancel drive transmission. Further, the contact-separation operation of the developing unit 4 with respect to the photosensitive drum 1 is performed with the developing device contact-separation motor 33 through the developing device contact-separation lever 32. A control portion 37 as a control unit drives and controls the drive motor 34, the clutch 36, and the developing device contact-separation motor 33.

Figure 5:
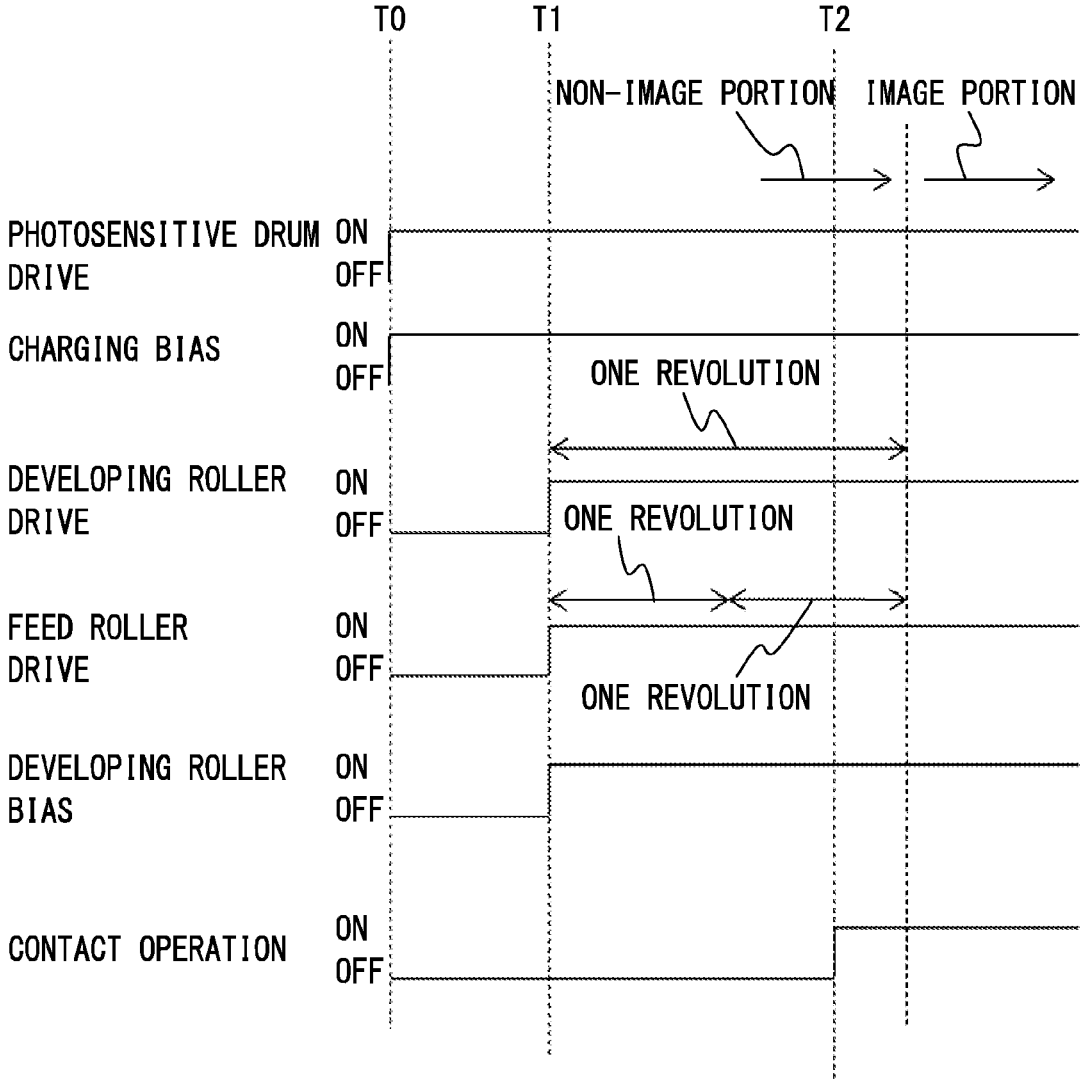
FIG. 5 is a timing chart according to the first embodiment.

FIG. 5 is a timing chart. At a time T0, the photosensitive drum 1 starts to be driven and rotated, and simultaneously, a predetermined charging bias is applied to the charging roller 2. At a time T1, the developing roller 17 and the toner feed roller 20 start to be driven before the photosensitive drum 1 and the developing roller 17 come into contact with each other. Simultaneously, a predetermined developing bias is applied to the developing roller 17. The toner feed roller 20 and the developing roller 17 are electrically short-circuited to each other. The photosensitive drum 1 and the developing roller 17 come into contact with each other at a time T2.

In the developing device according to the embodiment, the toner feed roller 20 and the developing roller 17 are rotated in a manner that the respective surfaces thereof move in the same direction (in the embodiment, direction from above to below) in the contact portion N. As described above, the toner feed roller 20 is rotated at 200 rpm in the direction of the arrow E in FIG. 2, and the developing roller 17 is rotated at 100 rpm in the direction of the arrow D in FIG. 2. In other words, during a time period between the time T1 and the time T2 illustrated in FIG. 5 (time period until the developing roller 17 comes into contact with the photosensitive drum 1), the number of revolutions of the toner feed roller 20 is larger than the number of revolutions of the developing roller 17.

By setting the number of revolutions of the toner feed roller 20 to be larger than the number of revolutions of the developing roller 17, toner can become sufficiently charged triboelectrically before the developing roller 17 comes into contact with the photosensitive drum 1. As a result, a fog phenomenon which may occur immediately after the contact can be suppressed. In addition, in comparison with a configuration in which the developing roller 17 and the toner feed roller 20 are rotated in a manner that the respective surfaces thereof move in directions reverse to each other in the contact portion N therebetween, the number of revolutions of the developing roller 17 for the triboelectrification of the toner can be reduced. As a result, shortening of a life of the developing roller 17 due to revolutions can be suppressed.

In order to elucidate the causes of the fog phenomenon, the inventors of the present invention carried out an experiment described below.

Figure 6:
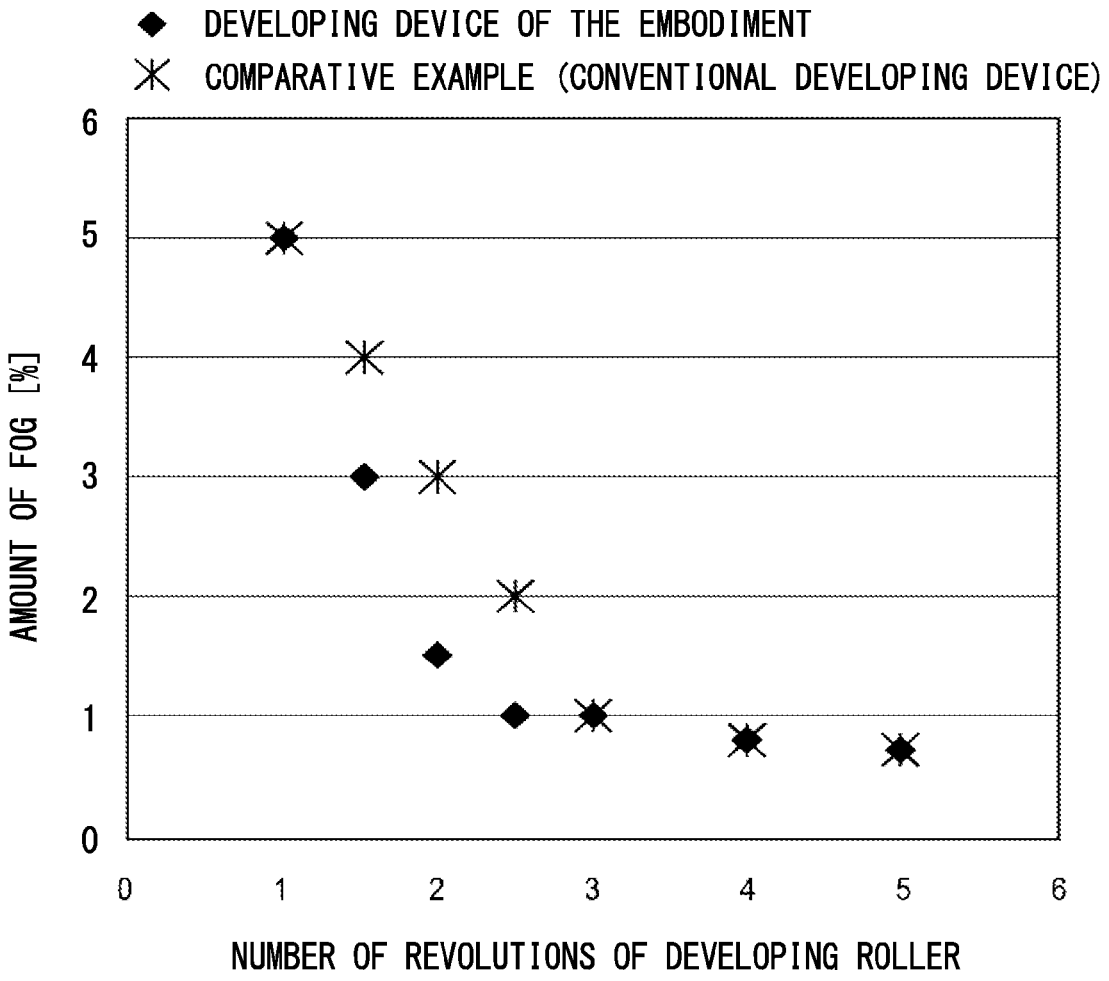
FIG. 6 is a graph showing fog transition in an image forming apparatus including a contact-separation mechanism modified according to the first embodiment.

FIG. 6 is a graph showing results of measurement of amounts of fog transferred from the developing roller onto the photosensitive drum in a case where an image forming operation is performed with use of an experimentally modified contact-separation mechanism in a state in which the photosensitive drum and the developing roller are always in contact with each other. For ease of comparison, an amount of fog in this image forming apparatus is indicated by a symbol different from that of a normal image forming apparatus using an unmodified contact-separation mechanism. FIG. 6 shows an amount of fog in an image forming apparatus using the developing device according to the embodiment and an amount of fog in an image forming apparatus using a conventional developing device according to a comparative example.

Here, the conventional image forming apparatus will be described. The conventional image forming apparatus has a general counter rotation configuration in which, unlike the image forming apparatus according to the embodiment, the toner feed roller and the developing roller are rotated at 90 rpm and 100 rpm, respectively, in a manner that the respective surfaces thereof move in directions reverse to each other in the contact portion therebetween. This configuration enables toner feed to the developing roller and scraping-off of non-developed residual toner from the developing roller to be performed simultaneously with each other. The number of revolutions of the developing roller per unit time is set to be larger than the number of revolutions of the toner feed roller. This is because a direction in which the number of revolutions of the toner feed roller becomes larger corresponds to a direction in which the rubbing intensity between the developing roller and the toner feed roller becomes higher. The higher rubbing intensity involves greater damage to toner and increases in rotation drive torque of each of the developing roller and the toner feed roller. Specifically, the greater damage to toner causes deterioration in image quality, and in order to generate higher rotation drive torque, larger motors need to be provided to the image forming apparatus.

Meanwhile, in the image forming apparatus 100 according to the embodiment, during the time period until the developing roller 17 comes into contact with the photosensitive drum 1, the number of revolutions of the toner feed roller 20 is larger than the number of revolutions of the developing roller 17. Specifically, the toner feed roller 20 and the developing roller 17 are rotated at 200 rpm and 100 rpm, respectively, in a manner that the respective surfaces thereof move in the same direction (in the embodiment, direction from above to below) in the contact portion N therebetween.

FIG. 6 shows that, in comparison with the configuration of the conventional image forming apparatus, with the configuration of the image forming apparatus according to the embodiment, the fog is suppressed earlier, and the amount of fog is reduced at a smaller number of revolutions of the developing roller. In other words, a time period of preparatory revolution for driving the developing roller can be shortened. The reason for this will be described below.

At the time of start of revolution of each of the developing roller 17 and the toner feed roller 20, toner carried on the developing roller 17 and toner captured in the toner feed roller 20 are sharply reduced in electric charge amount along with the elapse of time after rubbing in a previous image forming operation. Thus, the electric charges of both the toners are mostly lost. Therefore, the amount of fog is large at an initial stage of the revolutions of the developing roller 17 and the toner feed roller 20.

In the embodiment, the number of revolutions of the toner feed roller 20 is larger than the number of revolutions of the developing roller 17. Therefore, the toner feed roller 20 rotates one or more revolutions before the developing roller 17 rotates one revolution. With this, the toner captured in the toner feed roller 20 is discharged from the toner feed roller 20. Simultaneously, the toner feed roller 20 newly captures toner existing in the developing chamber 19. In this way, those toners are electrically charged by being sufficiently rubbed against each other in the contact portion between the toner feed roller 20 and the developing roller 17. In other words, along with the revolution of the toner feed roller 20, the electric charge amount of the toner captured in the toner feed roller 20 and fed to the developing roller 17 increases toward a saturation value. As a result, the amount of fog is reduced.

In contrast, in the comparative example, the toner feed roller 20 has not yet rotated one revolution even after the developing roller 17 rotates one revolution. Thus, the toner fed from the toner feed roller 20 to the developing roller 17 is not sufficiently rubbed even after the developing roller 17 rotates one revolution, and hence the electric charge amount of the toner has not yet risen. As a result, in comparison with the embodiment, the amount of fog is not reduced at the smaller number of revolutions of the developing roller 17.

According to the embodiment, the fog which may occur immediately after the contact of the photosensitive drum 1 and the developing roller 17 can be suppressed in the configuration in which the number of revolutions of the developing roller 17 is minimized. Thus, in comparison with the comparative example, a time period of the revolution of developing roller 17 can be prevented from becoming unnecessarily longer. As a result, problems such as earlier end of life of the developing roller 17, and occurrence of downtime corresponding to the time period of preparatory revolution for driving the developing roller can be solved.

In the embodiment, as illustrated in the timing chart of FIG. 5, at the time T2 at which the developing roller 17 and the photosensitive drum 1 come into contact with each other, the toner feed roller 20 has already rotated one or more revolutions. In other words, at the time point at which the developing roller 17 rotates one revolution, an amount of the revolution of the toner feed roller 20 has already exceeded an amount of the revolution of the developing roller 17. With this, the toner fed from the toner feed roller 20 to the developing roller 17 is sufficiently electrically charged. Thus, according to the embodiment, as illustrated in FIG. 5, at the time point when the developing roller 17 rotates one revolution, a fog-free image forming operation can be started. In other words, according to the embodiment, in comparison with the comparative example, occurrence of fog can be prevented despite the small number of revolutions of the developing roller 17, and the image forming operation can be started earlier.

Note that, in the embodiment, as illustrated in the timing chart of FIG. 5, the time T2 at which the developing roller 17 and the photosensitive drum 1 come into contact with each other corresponds to a time after the toner feed roller 20 has already rotated one or more revolutions. In this case, the developing roller 17 need not have rotated one revolution at the time T2 as long as the developing roller 17 has been rotated by an amount corresponding to a length larger than a circumferential length from the contact portion N between the developing roller 17 and the toner feed roller 20 to another contact portion between the developing roller 17 and the photosensitive drum 1. Also in this case, toner is sufficiently electrically charged, and hence occurrence of fog can be prevented. However, the present invention is not limited thereto. For example, the developing roller 17 and the photosensitive drum 1 may be brought into contact with each other at the time point at which the developing roller 17 rotates one revolution. In this case, the toner feed roller 20 rotates one or more revolutions (in this case, two revolutions), and hence the toner is sufficiently electrically charged.

As exemplified in the embodiment, the developing roller 17 and the toner feed roller 20 have the same diameter (in the embodiment, diameter of 15 mm). However, the present invention is not limited thereto. For example, the developing roller 17 and the toner feed roller 20 need not have the same diameter as long as the developing roller 17 rotates one revolution and the toner feed roller 20 rotates one or more revolutions before the developing roller 17 and the photosensitive drum 1 come into contact with each other. Also with this, the fog which may occur immediately after the contact of the photosensitive drum 1 and the developing roller 17 can be eliminated.

Further, as exemplified in the embodiment, the toner feed roller 20 and the developing roller 17 are rotated in a manner that the respective surfaces thereof move in the same direction in the contact portion therebetween. However, the developing roller 17 and the toner feed roller 20 may rotate one revolution and one or more revolutions, respectively, in other configurations. For example, as in the comparative example, there may be employed a counter rotation configuration in which the toner feed roller 20 and the developing roller 17 are rotated in a manner that the respective surfaces thereof move in the directions reverse to each other in the contact portion therebetween. However, in the counter rotation configuration, a peripheral speed difference between the developing roller 17 and the toner feed roller 20 in the contact portion is much larger than that in the configuration of the embodiment. Thus, in comparison with the configuration in which the developing roller 17 and the toner feed roller 20 are rotated in a manner that the respective surfaces thereof move in the same direction, the counter rotation configuration involves an unnecessary increase in rubbing intensity. As a result, there arise problems of greater damage to toner and increases in rotation drive torque of each of the developing roller 17 and the toner feed roller 20. Specifically, the greater damage to toner causes deterioration in image quality, and in order to generate higher rotation drive torque, larger motors need to be provided to the image forming apparatus.

In the configuration of the embodiment, the toner feed roller 20 and the developing roller 17 are rotated in a manner that the respective surfaces thereof move in the same direction in the contact portion therebetween. Thus, a peripheral speed difference in the contact portion can be reduced in comparison with that in the counter rotation configuration. Therefore, the problems of deterioration in image quality due to the greater damage to toner, and the necessity to provide the larger motors with respect to the image forming apparatus so as to increase the torques are not caused. For this reason, the configuration exemplified in the embodiment, in which the developing roller 17 and the toner feed roller 20 are rotated in a manner that the respective surfaces thereof move in the same direction, is more preferred than the counter rotation configuration.

As described above, according to the embodiment, generation of fog can be suppressed. As a result, a problem of marking back of the recording material caused by toner transferred from the developing roller 17 onto the recording material such as the recording sheet via the photosensitive drum 1 and a transfer device can be solved. Simultaneously, an unnecessary increase of the number of revolutions of the developing roller 17 can be prevented, and hence shortening of the life of the developing roller 17 can be suppressed.

Second Embodiment

A second embodiment of the present invention will be described. Both a developing device and an image forming apparatus according to the second embodiment are the same as those described in the first embodiment.

In the embodiment, a predetermined voltage (developer feed bias) is applied from a bias power source (not shown) not only to the developing roller 17 but also to the toner feed roller 20. With this, toner can be stably fed to the developing roller 17. Further, the toner used in the embodiment is negatively chargeable, and hence, while the developing bias Vdc of −300 V is applied to the developing roller 17, a voltage Vrs of −500 V is applied to the toner feed roller 20 so that a negative electric field is generated in a toner feeding direction.

Figure 7:
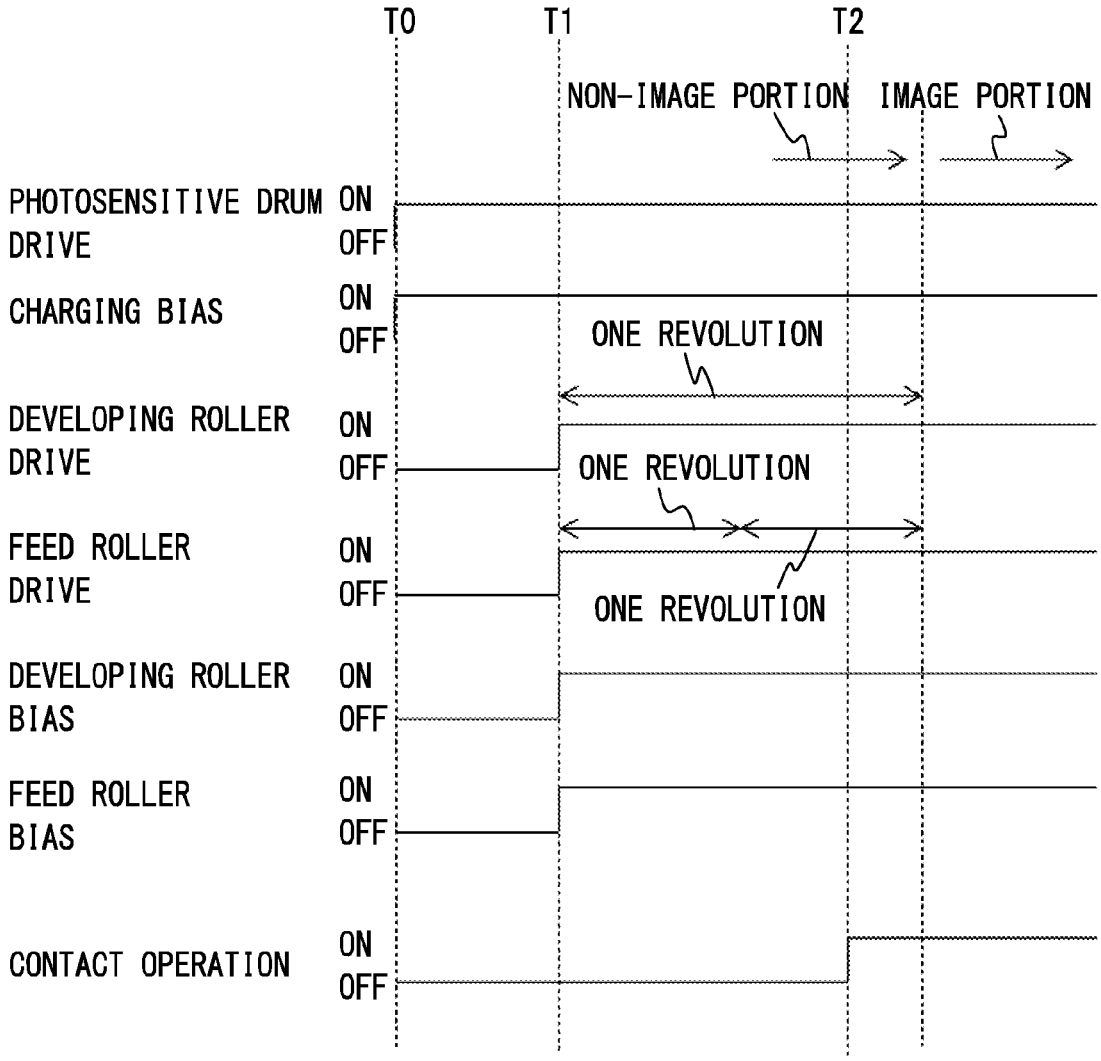
FIG. 7 is a timing chart according to a second embodiment of the present invention.

FIG. 7 is a timing chart. At the time T0, the photosensitive drum 1 starts to be driven and rotated, and simultaneously, a predetermined charging bias is applied to the charging roller 2. At the time T1, the developing roller 17 and the toner feed roller 20 start to be driven before the photosensitive drum 1 and the developing roller 17 come into contact with each other. Simultaneously, a predetermined developing bias is applied to the developing roller 17, and similarly, a developer feed bias is applied to the toner feed roller 20.

Note that, the configuration of the second embodiment is the same as that of the first embodiment described above except that the biases are applied respectively to the developing roller 17 and the toner feed roller 20, and hence description thereof is omitted herein.

For example, even when fluidity of the toner is lowered due to a low-temperature and low-humidity environment, as in the first embodiment described above, also in the embodiment, the time period of preparatory revolution for driving the developing roller 17 can be shortened. The reason for this will be described below.

At the time of start of revolution of each of the developing roller 17 and the toner feed roller 20, toner carried on the developing roller 17 and toner captured in the toner feed roller 20 are sharply reduced in electric charge amount along with the elapse of time after rubbing in a previous image forming operation. Thus, the electric charges of both the toners are mostly lost. Therefore, the amount of fog is large at an initial stage of the revolutions of the developing roller 17 and the toner feed roller 20.

Also in the embodiment, the number of revolutions of the toner feed roller 20 is larger than the number of revolutions of the developing roller 17. Therefore, the toner feed roller 20 rotates one or more revolutions before the developing roller 17 rotates one revolution. However, the fluidity of the toner is lowered due to the low-temperature and low-humidity environment, and hence a discharge amount of the toner captured in the toner feed roller 20 from the toner feed roller 20 is smaller than that in a normal environment.

Therefore, in the embodiment, the bias is applied to the toner feed roller 20, and hence the toner captured in the toner feed roller 20 is discharged from the toner feed roller 20 sufficiently. Simultaneously, the toner feed roller 20 newly captures toner existing in the developing chamber 19. In this way, those toners are electrically charged by being sufficiently rubbed against each other in the contact portion between the toner feed roller 20 and the developing roller 17. In other words, along with the revolution of the toner feed roller 20, the electric charge amount of the toner captured in the toner feed roller 20 and fed to the developing roller 17 increases toward a saturation value. As a result, the amount of fog is reduced.

As described above, according to the embodiment, generation of fog can be suppressed. As a result, the problem of marking back of the recording material caused by toner transferred from the developing roller 17 onto the recording material such as the recording sheet via the photosensitive drum 1 and the transfer device can be solved. Simultaneously, an unnecessary increase of the number of revolutions of the developing roller 17 can be prevented, and hence shortening of the life of the developing roller 17 can be suppressed. In particular, in the embodiment, the bias is applied also to the toner feed roller 20, and hence toner can be more stably fed to the developing roller 17.

Other Embodiments

The image forming apparatus 100 exemplified in each of the first and second embodiments described above includes the four image forming portions SY, SM, SC, and SK. However, the number of image forming portions to be used is not limited thereto, and may be set as appropriate. Further, the image forming apparatus 100 is configured to form a color image. However, the image forming apparatus 100 is not limited thereto, and may form a monochromatic image.

Further, the process cartridge 7 exemplified in each of the first and second embodiments described above, which is removably mounted to the image forming apparatus main body 100A, integrally includes the photosensitive drum 1 and the charging unit 2, the developing unit 4, and the cleaning unit 6 as a processing unit for the photosensitive drum 1. The process cartridge 7 is not limited thereto, and may include at least the photosensitive drum 1 and the developing unit 4. Alternatively, the process cartridge 7 may integrally include any one of the charging unit 2 and the cleaning unit 6 in addition to the photosensitive drum 1 and the developing unit 4.

Still further, the image forming apparatus 100 exemplified in each of the first and second embodiments described above includes the image forming apparatus main body 100A to which the process cartridge 7 including the photosensitive drum 1 is removably mounted. However, the image forming apparatus 100 is not limited thereto. For example, the photosensitive drum 1 and the processing unit configured to act on the photosensitive drum 1 may be incorporated into the image forming apparatus 100, or the photosensitive drum 1 and the processing unit configured to act on the photosensitive drum 1 may be removably mounted to the image forming apparatus 100.

Still further, the image forming apparatus 100 exemplified in each of the first and second embodiments described above is a printer. However, the present invention is not limited thereto, and the image forming apparatus 100 may be other image forming apparatus such as a copying machine, a facsimile machine, and a multifunction peripheral having functions of those apparatus. Further, the image forming apparatus 100 uses the intermediate transfer member so that toner images of a plurality of colors are sequentially transferred in a superimposed manner onto the intermediate transfer member, and the toner images borne on the intermediate transfer member are collectively transferred onto the recording material. However, the present invention is not limited thereto as well, and the image forming apparatus 100 may use a recording material carrying member so that the toner images of the plurality of colors are sequentially transferred in a superimposed manner onto the recording material while the recording material is carried by the recording material carrying member. Even when the present invention is applied to those image forming apparatuses, the same advantages can be obtained.

According to the embodiments of the present invention, developer can sufficiently become charged triboelectrically before the electrophotographic photosensitive member comes into contact with the developer carrying member. As a result, the fog phenomenon which may occur immediately after the contact of the electrophotographic photosensitive member and the developer carrying member with each other can be suppressed. In addition, shortening of the life of the developer carrying member due to its revolutions for charging toner triboelectrically can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101861, filed Apr. 26, 2012, which is hereby incorporated by reference herein in its entirety.

What is claimed is:

1. An electrophotographic image forming apparatus, comprising:

an electrophotographic photosensitive member configured to bear an electrostatic latent image;

a developer carrying member configured to carry developer and develop the electrostatic latent image in a state in which the developer carrying member is in contact with the electrophotographic photosensitive member; and a developer feed member configured to feed the developer to the developer carrying member in a state in which the developer feed member is in contact with the developer carrying member, wherein the electrophotographic photosensitive member and the developer carrying member are separated from each other during non-image formation and brought into contact with each other after the electrophotographic photosensitive member and the developer carrying member start to be rotated, and wherein, during a time period between a time when the electrophotographic photosensitive member and the developer carrying member start to be rotated and a time when the electrophotographic photosensitive member and the developer carrying member are brought into contact with each other, a number of revolutions of the developer feed member is larger than a number of revolutions of the developer carrying member.

2. An electrophotographic image forming apparatus according to claim 1, wherein the developer carrying member and the developer feed member are rotated in a manner that a surface of the developer carrying member and a surface of the developer feed member move in a same direction in a contact portion between the developer carrying member and the developer feed member.

3. An electrophotographic image forming apparatus according to claim 1, wherein the developer carrying member rotates one or more revolutions before coming into contact with the electrophotographic photosensitive member.

4. An electrophotographic image forming apparatus according to claim 1, wherein, at a same time or before the developer carrying member and the developer feed member start to be rotated, a developing bias is applied to the developer carrying member and a developer feed bias is applied to the developer feed member.

5. An electrophotographic image forming apparatus according to claim 1, wherein the developer carrying member and the developer feed member are provided in a developing chamber which is partitioned above a developer containing chamber configured to contain the developer, and wherein the developer contained in the developer containing chamber is conveyed toward an upper portion of the developer feed member by a conveying member provided in the developer containing chamber.

6. An electrophotographic image forming apparatus according to claim 1, further comprising a process cartridge which is removably mounted to the electrophotographic image forming apparatus, wherein the process cartridge includes:

a first unit provided with the electrophotographic photosensitive member; and a second unit provided with the developer carrying member and the developer feed member, and wherein the first unit and the second unit pivot about a fulcrum portion so that the electrophotographic photosensitive member and the developer carrying member are brought into contact with each other and separated from each other.

7. A process cartridge removably mountable to a main body of an image forming apparatus, the process cartridge comprising:

an electrophotographic photosensitive member configured to bear an electrostatic latent image;

a developer carrying member configured to carry developer and develop the electrostatic latent image in a state in which the developer carrying member is in contact with the electrophotographic photosensitive member; and a developer feed member configured to feed the developer to the developer carrying member in a state in which the developer feed member is in contact with the developer carrying member, wherein the electrophotographic photosensitive member and the developer carrying member assume a contact state in which the electrophotographic photosensitive member and the developer carrying member are in contact with each other and a separate state in which the electrophotographic photosensitive member and the developer carrying member are separated from each other, wherein the developer carrying member and the developer feed member are rotated in a manner that a surface of the developer carrying member and a surface of the developer feed member move in a same direction in a contact portion between the developer carrying member and the developer feed member, and wherein, when the developer carrying member and the developer feed member are rotated in the separate state in which the electrophotographic photosensitive member and the developer carrying member are separated from each other, a rotation speed of the developer feed member is higher than a rotation speed of the developer carrying member.

8. A process cartridge according to claim 7, wherein the developer carrying member and the developer feed member are rotated in a manner that respective surfaces thereof move from above to below in the contact portion.

9. A process cartridge according to claim 7, wherein a developing bias is applied to the developer carrying member and a developer feed bias is applied to the developer feed member.

10. A process cartridge according to claim 7, further comprising:

a developer containing chamber configured to contain the developer;

a developing chamber which is disposed above the developer containing chamber and partitioned from the developer containing chamber; and a conveying member provided in the developer containing chamber and configured to convey the developer from the developer containing chamber to the developing chamber, wherein the developer carrying member and the developer feed member are provided in the developing chamber.

11. A process cartridge according to claim 10, wherein the developer contained in the developer containing chamber is conveyed toward an upper portion of the developer feed member by the conveying member.

12. A process cartridge according to claim 10, wherein the conveying member is rotated to convey the developer, and a rotation center of the conveying member is located below a rotation center of the developer carrying member and a rotation center of the developer feed member.

13. A process cartridge according to claim 10, wherein the conveying member is rotated to convey the developer, and a rotation direction of the conveying member is the same as a rotation direction of the developer feed member.

14. A process cartridge according to claim 7, further comprising:

a first unit provided with the electrophotographic photosensitive member; and a second unit provided with the developer carrying member and the developer feed member, and wherein the second unit is moved with respect to the first unit so that the electrophotographic photosensitive member and the developer carrying member are changed over between the contact state and the separate state.

15. A process cartridge according to claim 14, wherein the second unit pivots about a fulcrum portion with respect to the first unit.

* * * * *